US005458943A

United States Patent [19]

Taylor

[11] Patent Number: 5,458,943

[45] Date of Patent: Oct. 17, 1995

[54] SPIRAL SPACER

[76] Inventor: Donald M. Taylor, 3844 Sundown Dr., Nanaimo, British Columbia, Canada, V9T 4H5

[21] Appl. No.: 81,530

[22] Filed: Jun. 23, 1993

Related U.S. Application Data

[63] Continuation-in-part of Ser. No. 609,336, Nov. 5, 1990, Pat. No. 5,290,611.

[51] Int. Cl.[6] ..... E06B 3/24

[52] U.S. Cl. ..... 428/34; 52/786.1; 52/786.13

[58] Field of Search ..... 428/34.1, 192, 428/34, 34.2, 34.7, 35.4, 35.7, 35.8, 174, 317; 52/788, 790

[56] References Cited

U.S. PATENT DOCUMENTS 3,655,502 4/1972 Yoshikawa ..... 428/182

*Primary Examiner*—Donald J. Loney
*Attorney, Agent, or Firm*—Caesar, Rivise, et al.

[57] ABSTRACT

A spacer/seal for use in multi-pane glazing units, to provide a thermally non-conductive peripheral hermetic seal comprises a hollow tube of selected cross-sectional form, built up of a laminated construction of helically wound laminated layers and incorporating a layer or layers of gas impermeable barrier material to ensure long lived hermetic sealing characteristics. The construction may include respective layers wound to opposite hand, and layers wound to different lead angles. Also, the gas impermeable barrier layer or layers may be selected from materials that serve as adhesive to the laminated structure. Suitable barrier layers may be selected from polyvinyl alcohol, polyvinylidene chloride, thermoplastic polyesters, ethylene vinyl alcohol copolymers, and combinations thereof. The structure of the spacer lends itself to low-cost continuous manufacture on a tube-making machine having a rotating mandrel of selected cross-section onto which the layers of flexible web-substrate material are laminated, each as a continuous spiral wind, with continuous off-feed of the formed and laminated spacer/seal from the free end of the mandrel. Paper or light cardboard of suitable basis weight form a very suitable, low-cost fibrous web for spiral winding as the structural material upon which the hermetic sealing layer material may be readily coated. The method and materials of manufacture enable the provision of spacer/seals of novel shape. Larger size tubes made in accordance with the present invention may also be used for long term storage including freezer storage, where the capability of providing flat-walled containers of square or rectangular section in a virtually unlimited range of sizes ensures optimum space utilization, while the hermetic seal characteristics of the wall construction promotes long term storage without spoiling due to dehydration or atmospheric contamination. Also, the capability of long term retention of inner "storage" gases such as carbon dioxide, nitrogen, etc. is enhanced.

15 Claims, 5 Drawing Sheets

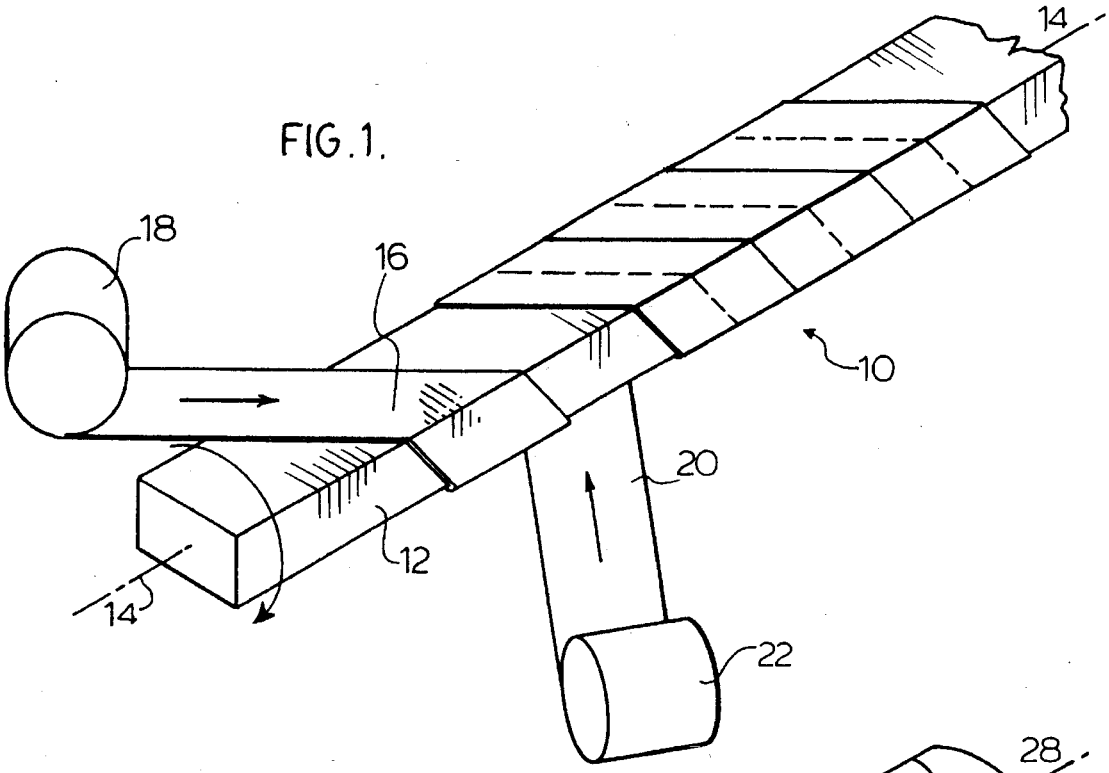
FIG. 1.
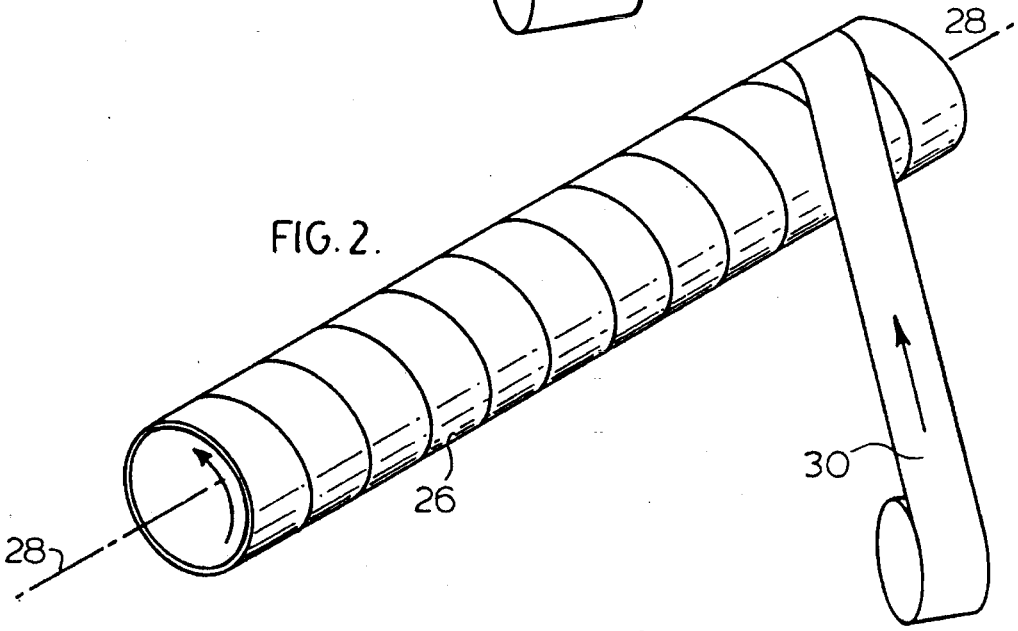
FIG. 2.
FIG. 3.
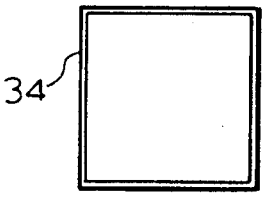
FIG. 4.
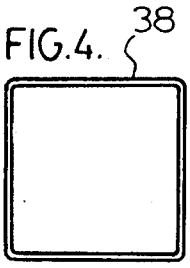
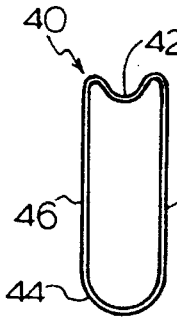
FIG. 5.

FIG. 8.
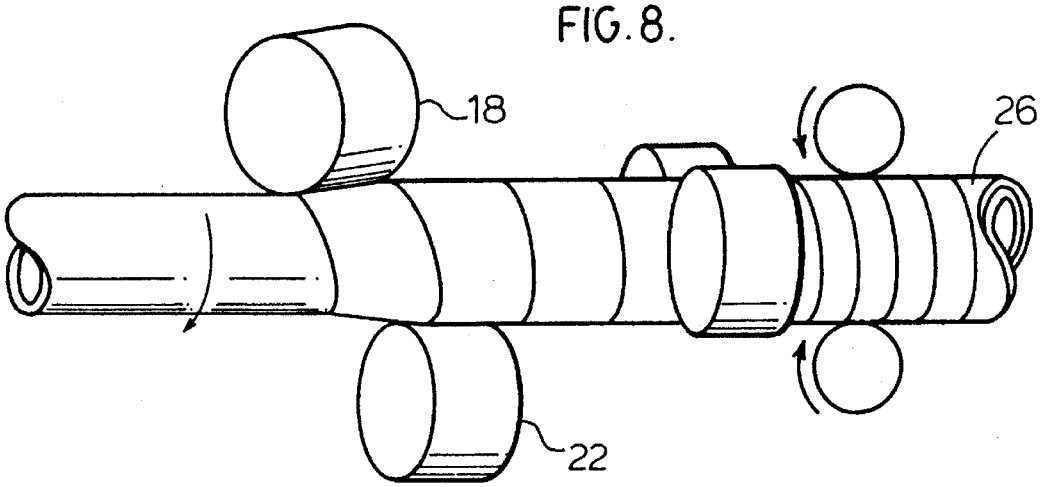
FIG. 9.
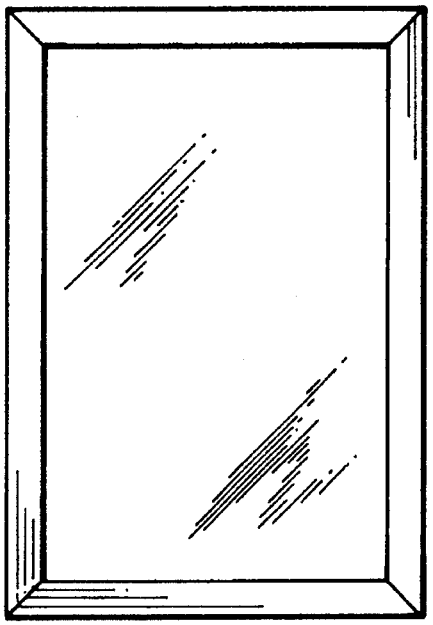
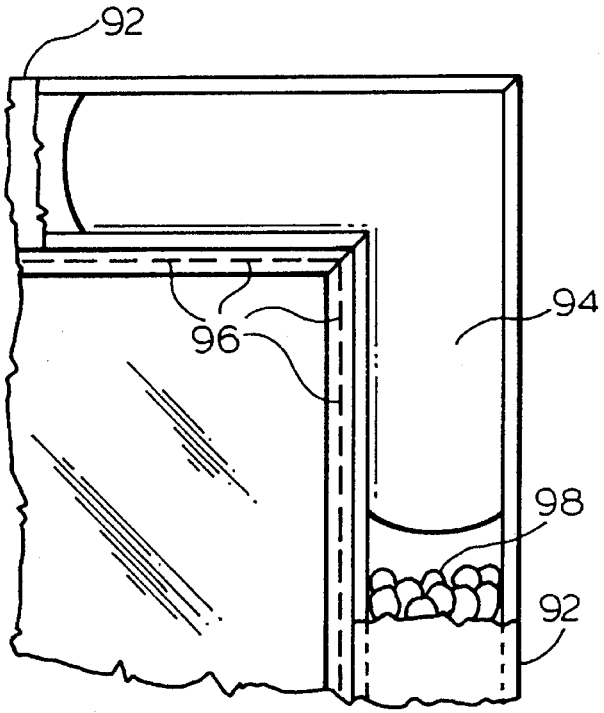
FIG. 10.

SPIRAL SPACER

This application is a continuation-in-part of application Ser. No. 07/609,336, filed Nov. 5, 1990 by the present inventor, now U.S. Pat. No. 5,290,611.

TECHNICAL FIELD

This invention is directed to a process for manufacturing a laminated tube, and in particular to a laminated tube having a wall with hermetic sealing characteristics, and suitable for uses including that as a spacer seal in multi-paned lights.

BACKGROUND ART

Spiral-wound cardboard forms are very well known, being used as the central core for paper toilet roll, and also as containers for candies and foodstuffs; as forms for pouring concrete pillars, and as bulk shipping containers. Such prior art containers are generally characterized by the porous nature of the spiral-wound wall.

In the field of multi-paned glazing lights, such as windows, patio doors, rooflights and the like, in which two or more panes of glass or other glazing material are framed in spaced-apart, edge-sealed relation, various efforts have been made to provide a spacer/seal possessing high sealing integrity combined with low thermal conductivity. The most widely used spacer/seals have been of aluminum extruded sections, more recently incorporating some form of thermal break at the "inner" surface, i.e. the surface bounding the interior space enclosed by the glass panes. Such lights are subject to "sweating" and frost formation under extremely cold conditions due to thermal bridging between the adjacent panes, caused by heat conduction by the spacer.

In the case of hospital and other institutional facilities, widely spaced panes have in many instances utilized stainless steel spacers of considerable lateral width, where sound transmission has proved to be a problem.

Previous efforts by the present inventor in the provision of improved non-metallic spacer/seals have been directed to utilizing paper, cardboard and other suitable low-cost fibrous sheet materials laminated into ribbon form, and incorporating one or more sealing coatings to provide a cohesive, hermetic sealing layer selected from a family of superior plastic substances. These substances also may in many instances form a part of the ribbon laminating process. The thus-formed ribbons are generally scored longitudinally, to provide fold lines by means of which the ribbons can be formed into an elongated hollow spacer/seal formulation, for bonding between a pair of panes, to form a sealed light.

This prior process is quite practical, to yield a low-cost, effective spacer/seal. As with any product, however, the costs both of material and of production require to be held to the minimum. Also, in the case of mass production, the provision of a suitable seal that is completely ready for installation, without requiring assembly from a pre-formed ribbon into its tubular form, would comprise a distinct advantage.

DISCLOSURE OF THE INVENTION

The present invention provides a process for making spiral-wound hollow containers having a laminated wall construction of substantially hermetic sealing capability, comprising the steps of spiral winding a web upon a mandrel of selected cross-section, and applying a hermetic sealing coat, to substantially hermetically seal the wall of the tube thus formed.

The hermetic sealing coat may be applied as an adhesive to a face or faces of a laminate-layer being applied to form the wall of the container.

The laminated wall of the container may be built up of successive layers of spirally wound web material, wherein one or more of the layers of the web may be applied at either a common or at different pitch angles. The differentiated pitch angles may be complemented with spiral layers secondarily wound to the opposite handing, as a second, outer covering, referred to herein as being "counter-wound".

The adoption of opposite-handed laminates (i.e. counter-winding) requires the reversal of the direction of relative motion of the tube on application of the laminate, as by rotation in a clockwise direction for laminating the tube and then rotating the tube in an anti-clockwise direction for the succeeding counter-winding portion of the process in applying an outer layer.

A hermetic sealing layer and/or surface coating may be selected from the group consisting of polyvinyl alcohol, polyvinylidene chloride, thermoplastic polyesters, ethylene vinyl alcohol copolymers, and combinations thereof. The foregoing group is not intended to be exclusively limiting, and may include other substances possessing the appropriate physical characteristics.

Certain adhesive/sealant layers such as "SARAN" can be pre-coated or laminated onto the web material, which can subsequently be laminated onto or into a tube by the application of heat, in order to fuse the adhesive/sealant. Thus, a web pre-coated with adhesive/sealant can be coiled into a roll, applied by spiral winding over a form or a mandrel, or a formed tube, and laminated in sealing, adhering relation therewith by the application of heat.

Adoption of this manner of tube laminating enables the continuous spiral winding of a tube upon a non-rotating mandrel, the roll or rolls of pre-coated web being rotated bodily about the polar axis of the tube, to form the spiral winding which is heated, during or after winding, in order to fuse the adhesive and secure the web in laminated relation to the underlying layer.

The apparatus may include a hollow mandrel of selected cross-sectional shape, through which material such as a dessicant may be supplied internally within the spiral-wound container during its formation, being fed through the hollow mandrel.

A hollow mandrel of selected sectional shape may also utilize the interior of the mandrel to apply vacuum, or lubricating air to the web and/or the tube, at the outer surface of the mandrel.

Thus, in an elongated mandrel having a perforated surface to permit the passage of air therethrough, vacuum and/or pressurized air can be supplied by pipe or directly through the interior of the mandrel.

A first length of perforated mandrel having vacuum applied thereto provides a vacuum zone that can assist in the conforming of the on-laying web to the surface of the mandrel. This may facilitate the use of mandrels whose cross-section includes inwardly curved, outwardly concave surfaces.

An adjacent length of perforated mandrel may receive air under pressure, to form a pressure zone, separated from the first, vacuum zone by an internal bulkhead within the mandrel. Air supplied through a tube within the mandrel can then create an air film, to facilitate axial sliding displacement of the formed, spiral-wound tube along and off the mandrel.

The use of a rotatable mandrel is preferred. However, the application of the web material to the mandrel may be achieved by wrapping the web material about a stationary mandrel, or a selectively rotatable mandrel.

Either process presents its own particular problems.

The selection of the cross-sectional form of the mandrel can cover a wide range of shapes.

A triangular section mandrel can be readily used, in stationary or rotating mode.

The apparent unsuitability of such a three-cornered section for application as a spacer between two sheets of glass may be overcome by the making up of the spacer into a frame, akin to a picture frame, which serves to stabilize the triangular section: Thus, in its frame form the spacer can be readily handled, inserted between two glazing panels, and sealed into place.

Alternative available shapes can include rectangular, square, and composite shapes such as that having parallel top and bottom surfaces, and opposed side faces that are "cranked" outwardly at about their midline, each side forming a pair of adjoining panels that are mutually inclined, to provide a lateral bellying-out effect to the section. These shapes may be generated in the cross-sectional shape of the mandrel upon which the tube is wound.

In addition to the application of web material in wound relation about the periphery of the mandrel, a layer or layers may additionally be applied as a strip, along one or more faces of the mandrel section. Thus, an aluminum strip may be applied to one face of a square or rectangular mandrel and secured during the manufacturing process by the overlying spiral wound web layers. The strip then is drawn along the mandrel with the travel of the laminated tube as it forms, to become an integral part of the tube. Such an arrangement using a rotating mandrel would also require the provision of a coil or magazine of the aluminum strip rotating in synchronism with the mandrel about the polar axis of the mandrel.

The present invention thus provides an elongated tube having a laminated wall constructed of a plurality of spirally wound layers in mutually superposed relation, the wall including a substantially hermetic sealing layer in bonded relation with at least one layer of the laminated wall.

The aforesaid tube may be formed with at least two planar wall surfaces, to provide suitable bonding surfaces for joining a pair of glazing panes in sealed; relation with the spacer/seal.

The spirally wound tube may include a counter-wound layer or layers that are applied during reversed rotation of the tube.

In one preferred embodiment the hermetic sealing layer serves as an adhesive, to adhere one or more layers of the laminate to an adjoining layer thereof.

It will be understood that a hermetic sealing layer may be "painted" or otherwise applied as a coating to an intermediate laminate layer or to the outer surface of the tube.

The present invention particularly lends itself to low cost production using paper or cardboard as the web material. Use of a paper having a thickness of about 3 or 4 thousandths of an inch, (3 or 4 "thou"; i.e. 0.003 or 0.004 inches), or a 5-point cardboard (5-thou thick) can, with two or three plies thickness result in a tube of unexpected strength.

One aspect of the unexpected strength of such thin-walled tubes is the use of endless web, with the fibres thereof longitudinally oriented as a consequence of the normal papermaking process.

The application of thus oriented web into a spiral conveys the longitudinal strength characteristics of the fiber to the final structure. When counter-winding is used, the tube construction is correspondingly stiflened and strengthened.

In contrast to this high structural strength, the previous consideration of the present inventor to using a longitudinal ribbon in laterally folded relation to make a spacer/seal would require approximately double the wall thickness to achieve strength equivalent to the present structure.

The use of suitable plastic films as a web material in the winding of tubes also is contemplated.

The size of the tubes for use as spacer/seals may range from cross-sections with peripheral .lengths of six-inches or even more, down to appreciably smaller sizes having a periphery of a very few inches, such as the two to three-inch range.

The well-known tendency of straight-sided tubular sections to warp by "winding", i.e. to take on a slight twist about its polar axis, may be countered by the application of counter-torque to the formed or forming tube, to compensate for the inherent warpage. This is readily effected on cut lengths of the tube, in a stationary fixture. It is also possible to do this "on the run", during the continuous tube manufacturing process.

Protection of a spacer seal from ultra-violet (U/V) radiation may be of particular importance in some window installations. A spiral-wound tube of square/rectangular section particularly lends itself to the application by "labelling" with an aluminum strip along a specified surface or surfaces of the spacer.

When made up into a thermally insulating spacer frame, as is the usual way of utilizing such spacer/seals, an aluminum layer may be labelled on to the inner, inward-facing side of the spacer/seal.

Such an application would preferably be terminated short of the edges of that frame inner side so as not to contact the surface of the glass when installed in a window light.

The spiral-wound construction is most readily formed on a mandrel of circular section. The tube section may then be modified by passage of the uncured tube through a transition die. In the situation where the circular-section tube is initially formed upon a rotating mandrel, the succeeding step of the process, namely the passage of the uncured tube through a transition die may be carried out using a synchronously rotating transition die, followed by heat-curing the tube prior to parting-off into discrete lengths.

The tube may be spiral wound directly onto a mandrel of the desired cross-sectional configuration, such as rectangular or square or other selected section. In the case of slender tubes of low section modulus, intended for use as spacer/seals for glazing, the extreme vulnerability of the mandrel to whip, and to bending deformation under the tension forces generated by the rotating mandrel in drawing-off the laminating strip material from its respective rolls generally necessitates the use of steady bearings or equivalent provisions. These may be provided by making use of the axial feed rolls, which rotate bodily about the tube polar axis, as in synchronism therewith. By resiliently loading the surface of the feed roll against the mandrel and/or tube, this can provide the desired steadying effect.

For use as a glazing spacer/seal, the tube is cut to lengths corresponding with the side dimensions of the panel being fabricated, and suitable die-cast plastic corner pieces may be inserted in joined sealing relation into the tube ends, to complete the corners of the desired frame-shaped spacer/ seal.

The present invention also provides a method of forming an endless tube having a substantially hermetically sealed wall construction, comprising the steps of helically winding a plurality of layers in mutually overlying, laminated relation upon a mandrel of predetermined cross-section, and applying a hermetic sealing layer about the tube in bonding relation with at least one of the layers.

The method includes feeding the tube in sliding relation along the mandrel.

In one preferred embodiment the mandrel is rotated to draw the laminating layers in close wrapping, tensioned relation about the mandrel to form an imperforated tube wall.

The method includes applying a sealing coating of adhesive in adhering relation to one of the layers. This coating application step is preferably carried out before the winding of the layer in secured bonded relation about the tube.

The method may include passing the formed tube through a hollow die in profile re-forming relation with the tube cross-section. Use of this re-profiling step enables the initial forming of the tube upon a circular-section mandrel, which simplifies maintaining constant the tension in the ribbons that constitute the laminating layers, while simplifying the axial feeding of the forming tube along the roaring mandrel.

Subsequent passage through a re-profiling die or die rollers permits the ready provision of slender tubes of square or rectangular, or other more complex section. However, such re-profiling may require special measures in order to achieve consistent feeding from off the mandrel and through the die or die rolls.

The present method also includes the provision of selective heat curing of the formed and profiled tube; also the cutting or parting off of the tube into practical, easily handled lengths.

In the case of tubes having a counter-wound layer, this counter-winding step requires rotation of an already-formed tube in the direction opposite to the forming direction of rotation, to enable the application of the counter-wound layer.

BRIEF DESCRIPTION OF DRAWINGS

Certain embodiments of the present invention are described by way of illustration, without limitation of the invention thereto, reference being made to the accompanying drawings, wherein:

FIG. 1 is a diagramatic perspective presentation showing the application of a pair of mutually overlying tapes to a rotating mandrel of rectangular cross-section;

FIG. 2 is a like view of a tube having a counter-wound tape being applied thereto;

FIG. 3 is an end view of a square section tube in accordance with the invention;

FIG. 4 is a view similar to FIG. 3 of a square-section tube of re-formed profile;

FIG. 5 is a view similar to FIG. 4 of another re-formed tube profile;

FIG. 8 is a view similar to FIG. 6, of a further process embodiment;

FIG. 9 is a side view of a frame spacer/seal according to the invention;

FIG. 10 is a corner detail of the FIG. 9 frame.

BEST MODE OF CARRYING OUT THE INVENTION

Figure 11:
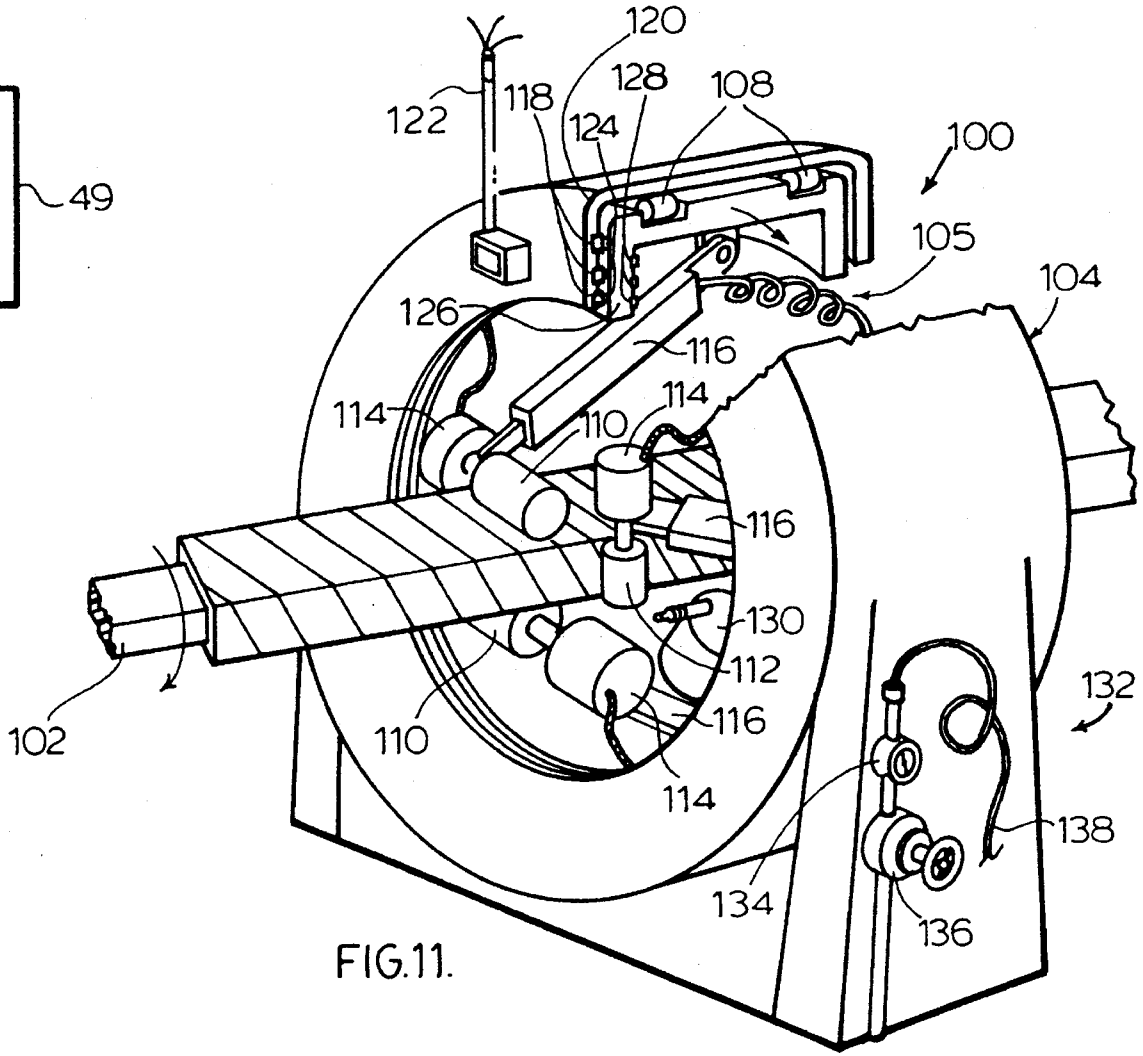
FIG. 11 is a perspective side view in partial section of a feed roll stand.

Referring to FIGS. 1 to 4, in FIG. 1 the arrangement 10 shows an elongated, rectangular section mandrel 12, rotatable about its polar axis 14, 14, having a first, underlying ply 16 from roll 18, and a second overlying ply 20 from roll 22 being drawn in snug, spirally wound relation about the mandrel 12.

In FIG. 2, a circular hollow tube 26 of laminated "clockwise-wound" construction is shown, having an axis 28, 28 of polar rotation, with a further layer 30 being laminated thereover, by counter-clockwise rotation of the tube 26, to provide a counter-wound laminate layer.

FIG. 3 shows an end view of a hollow tube 34 of square section; FIG. 4 shows a similar square-section tube 38 made by re-forming the profile thereof by passage of a circular-section laminated tube through a re-forming mandrel, resulting in radiused corners.

FIG. 5 shows a laminated tube 40 according to the present invention re-formed by passage thereof through roller dies, and having a pair of opposed flat sides 46, 46 for sealing attachment between a pair of glazing panes. The radiused sides 42, 44 of the tube section 40 facilitate expansion and contraction between the opposed flat sides 46 of the spacer/seal, and hence, of the dual-pane construction, under the influence of atmospheric changes in temperature and pressure, with consequent reduction in the tendency for deforming curvature of the glazing panes.

Figure 6:
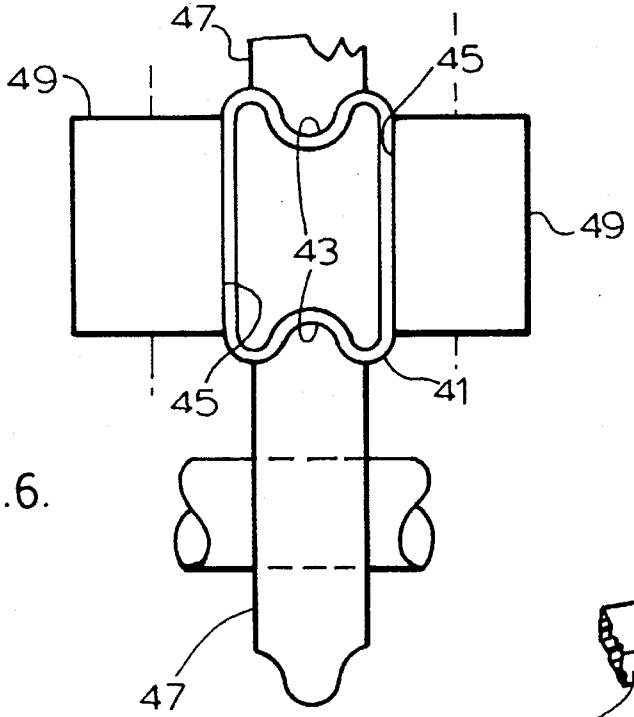
FIG. 6 is a schematic partial end view of another re-formed profile and the associated profiling rolls.

FIG. 6 shows a laminated tube 41 having opposed, inwardly radiused sides 43 and flat sides 45, with correspondingly profiled re-forming rolls 47, 49. The sides 43 facilitate containment of the frame bonding adhesive, particularly in the case of the polyisobutylene secondary outer frame seal, normally installed to protect the seal and glass outer edges. A complementary interior mandrel may also be used, which may include a perforated surface, for both "sucking" and "blowing" provisions to facilitate air lubricated operation of the mandrel.

Figure 7:
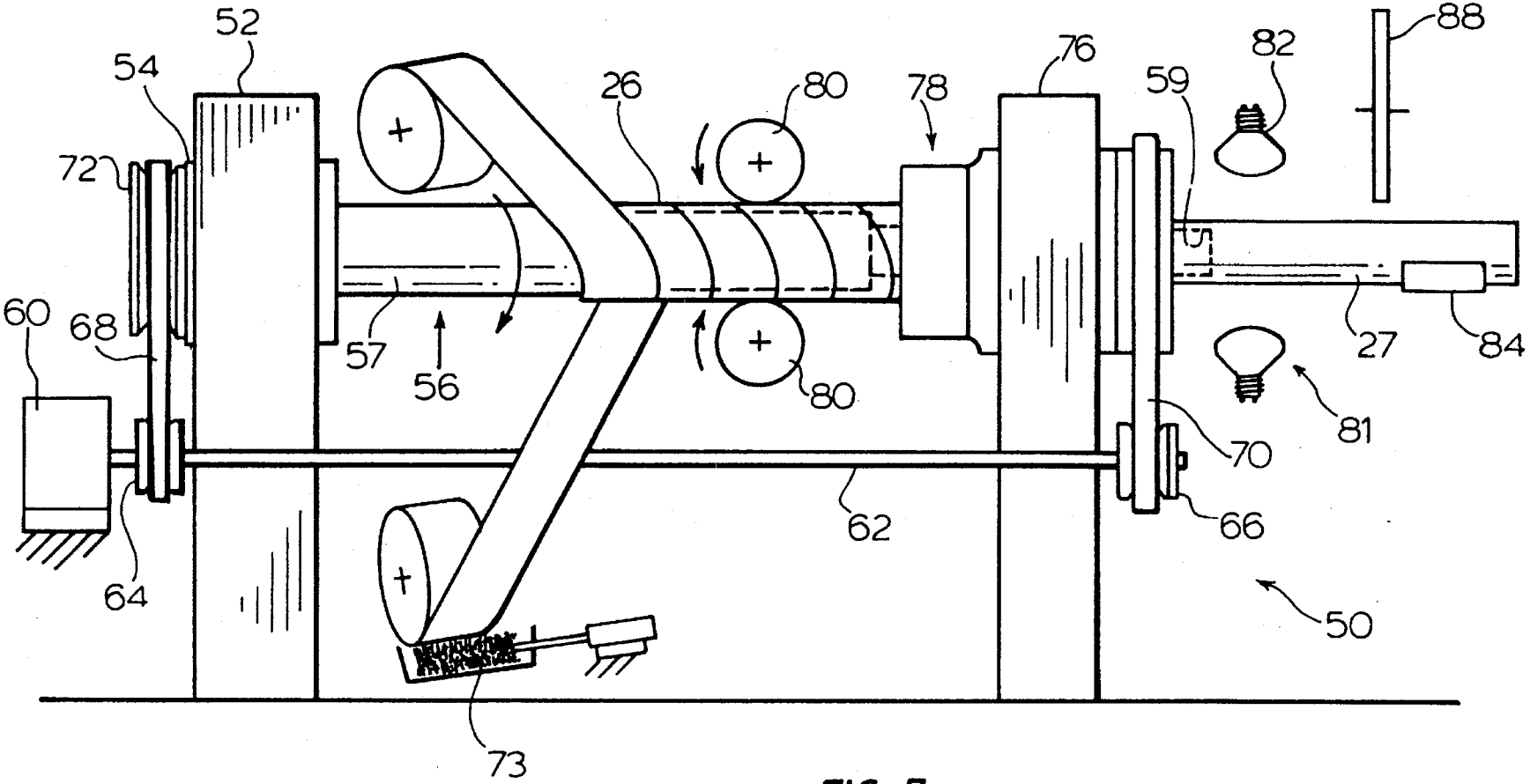
FIG. 7 is a side view in elevation of an apparatus for carrying out the process according to the present invention.

Referring to FIG. 7, the arrangement 50 comprises head post 52 having a rotatable chuck 54 from which a mandrel 56 extends in cantilevered relation. The arrangement is illustrated as having a driving motor 60 with synchronizing shaft 62, from which v-pulleys 64, 66 drive V-belts 68, 70. A head pulley 72 drives the chuck 54 and mandrel 56. A roller-brush 73 applies adhesive/sealant.

Tail post 76 rotatably supports a profile re-forming die 78, which is driven in synchronized rotating relation with the mandrel 56. The profile re-forming die 78 has an incoming profile of circular section, to receive the axially moving tube 26 in snugly fitting relation therein. The profile blends longitudinally, to a desired square or rectangular section profile at the right-hand outlet end of the die, where the re-formed tube emerges.

The mandrel 56 has a circular-section first portion 57, that reduces to a diminished diameter portion 59 (shown in phantom), that snugly fits the minimum inside diametrical dimension of the re-formed tube portion 27. The mandrel reduced end portion 59 serves as a steady to the rotating mandrel 56, to limit bowing and vibration thereof.

Driven rollers 80 serve to draw the tube 26 along the mandrel portion 57, as the tube 26 is forming, and feeds it through the profile re-forming mandrel 78. The rollers 80 may be skewed relative to the polar axis of the tube 26. Pulling rolls also may be used, similar to those illustrated in FIG. 11.

The emerging re-profiled tube 27 passes through a curing section 80, illustrated by infra-red heat lamps 82, and onto a set of support bearings 84 of a support table.

A transversely swinging circular saw 88 serves to part off the axially moving, rotating tube 27, for removal from the system.

Referring to the FIG. 8 process embodiment, it will be seen that the laminate feed rolls serve as steadies to the rotating tube and mandrel system, being held in resilient steadying relation with the forming tube.

Referring to FIGS. 9 and 10, a frame 90 comprises a laminated spacer/seal of hollow tubular section, in accordance with the invention. Referring to FIG. 10, the tube 92 has a corner piece 94 inserted therein in cemented sealing relation. It will be noted that the inner face of the frame 90 has perforations 96 therethrough, so that the dessicant 98 can maintain the interior sealed space of the glazing unit free of vapor.

FIG. 11 shows a rotary pulling stand 100 for drawing a profiled or re-profiled tube along a rotating mandrel 102, herein illustrated as being of rectangular section.

The stand 100 has a stator 104 supporting a rotating cage 106. The cage 106 is shown rotatably mounted upon roller bearings 108.

A set of driven, cylindrical profile pulling rolls 110, 110, 112 are shown, the opposed edge roll 112 being omitted to facilitate illustration.

The rolls 110, 112 are carried by respective electric motors 114 which are mounted upon extensible rams 116.

The motors may be A.C. induction motors, or D.C. machines, to provide the required, regulatable torque. The stand 100 has circular slip rings 118, set in the inside surface of the sidewall 120 thereof, and supplied from a regulatable A.C. supply 122. Brushes 124, carried by side wall 126 of cage 106 connect with bus bars 128 mounted inside the wall 126, of rotary cage 106 to which each of the motors 114 are connected.

The extensible rams 116, illustrated as being of rectangular section for purposes of lateral stability, constitute air springs, being each connected to an air bottle 130 that is mounted for rotation with the cage 106.

A regulatable air supply 132, with pressure guage 134 and reduction valve 136 are connectible by quick disconnect 138 to the inlet of air bottle 130 when the cage 106 is at rest.

The air pressure in the bottle 130 is set to give a desired reaction force to the respective rolls 110, 112 in applying the required tractive force to the spirally wound tube, to give a balanced axial tractive force to draw the tube, as it is forming, along and off the mandrel. The mandrel 102 extends in supporting relation beneath the rolls 110, 112.

As illustrated, the rotation of cage 106, with its individually and independently driven tube pulling rolls 110, 112 is imparted by the rotating mandrel and tube. However it is also contemplated that the cage 106 may be electrically driven, such as by the provision of an electric motor or motors in driving relation with a ring gear coupled to the cage 106.

As an alternative, the stator 104 and the cage 106 may be furnished with synchronous or induction motor components, for an independent drive, synchronized to the rate of rotation of the mandrel.

When the presence of naturally occurring winding or polar warpage is to be compensated, such an independent cage-drive can be adjusted, together with the location of the discharge end of the mandrel a selected distance short of the pull-off feed rolls, to apply a desired counter-torque to the formed tube, so as to straighten it "on the run".

It is further contemplated that the drive of the tube pulling rolls 110, 112 may be derived from the rotation of the cage 106. Thus, the provision of a non-rotating ring gear adjacent the cage 106 in meshing, driving relation with one or more pinion gears carried by the cage 106, and connected in driving relation with the rolls 110, 112 can provide the required drive to those rolls.

FIG. 112 is a plan sketch showing a stationary mandrel arrangement 150. The mandrel 152 is illustrated as being of square section, and could readily be of rectangular or other suitable cross-section profile.

A wheel 154 rotatably supported on bearing 156 carries a pair of inclined spindles 158 on which rolls 160 of "pre-glued" or coated web material, such as paper or light guage cardboard are mounted. The glue or coated material may be selected from the aforesaid group to provide adhesive and hermetic sealing qualities, or may be a simple "glue".

An adjustable friction drag brake at each spindle 158 may comprise an axially compressible dished washer 159, to control over-spin of the web rolls 160, and to tension the web draws 162, 164.

An electric motor 166 and drive belt 168 are mounted in driving relation with the pulley 170, secured to wheel 154.

Figure 12:
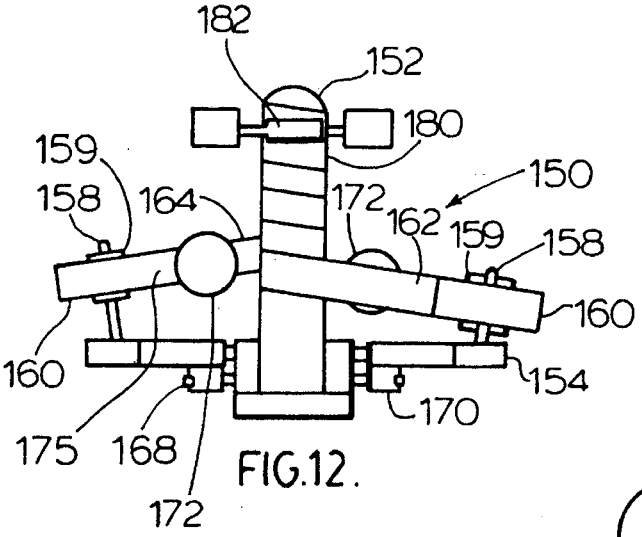
FIGS. 12, 13 and 14 are, respectively, schematic views in plan, and front and side elevation of a stationary mandrel winding apparatus for carrying out the present process.
Figure 13:
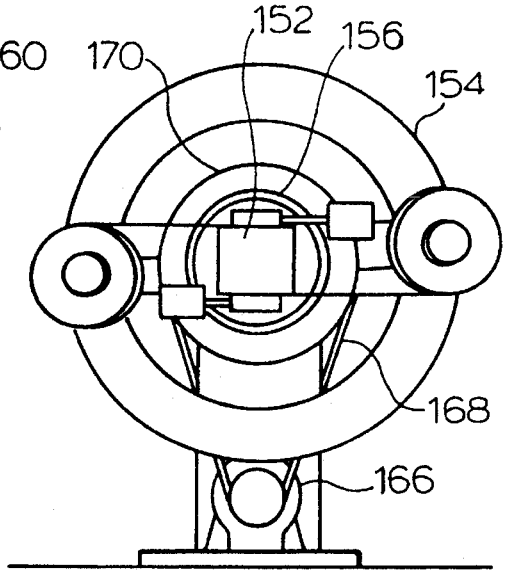
Figure 14:
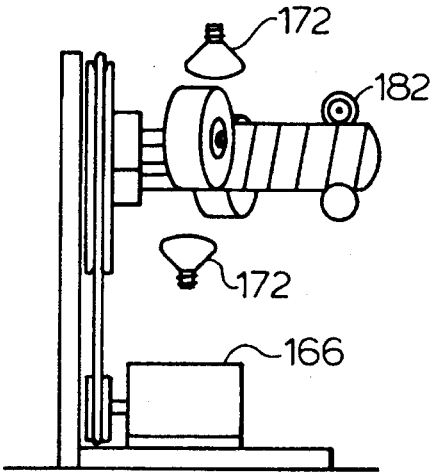

Heat lamps 172 (shown in FIGS. 12 and 14) make tacky the previously applied adhesive coat, which may also comprise a hermetic sealing layer, on the respective web faces 175, 177, such that the webs 162, 164 are laminated before the tube 180 is drawn axially off the mandrel 152 by feed rolls 182.

Figure 15:
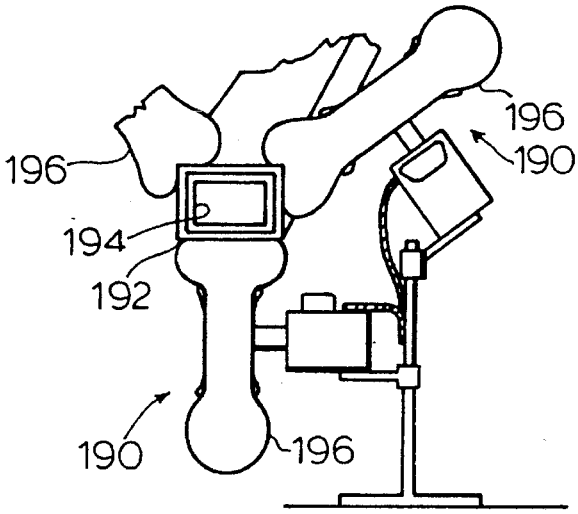
FIG. 15 is a diagramatic illustration of tube feeding rolls incorporating balloon tires for use with a rotating mandrel tube former.

In FIG. 15 there is illustrated three ultra-flexible feed rolls 190, arranged symetrically about the polar (rotational) axis of a helically wound tube 192, for drawing the tube 192 off its forming mandrel 194. The pneumatic balloon tires 196 of the feed rolls 190 are sufficiently large and flexible to accommodate to the instantaneously changing contact zones of the tube 192 as it rotates during its formation upon the mandrel 194.

The axes of the feed rolls 190 may be skewed to the axis of the mandrel, to facilitate the operation of the rolls, with due compensation being made to the rotational rate of the feed rolls 190.

It will be understood that the foregoing disclosure is made in regard to certain embodiments of the invention, without limitation for the invention thereto, the invention, being capable of reduction into many alternative embodiments.

INDUSTRIAL APPLICABILITY

This invention is of great potential use in the multi-pane glazing industry, and has significant potential for use in packaging perishable foodstuffs, such as meat for storage in deepfreeze conditions, or where space considerations and/or hermetic sealing is of significance.

What I claim by Letters Patent of the United States is:

1. The combination comprising a multi-paned light, including a closed frame located in sealed, spacing relation between a pair of panes of the light, said closed frame comprising an elongated tube having a laminated wall constructed of a plurality of spirally wound layers in mutually superposed relation, said wall including a planar, substantially hermetic sealing layer in bonded relation with at least one layer of the laminated wall.

2. The combination as set forth in claim 1, said tube having at least two planar wall surfaces.

3. The combination as set forth in claim 1, said wall having at least one counter-wound laminate layer.

4. The combination as set forth in claim 1, said hermetic sealing layer serving to adhere said at least one layer to an adjoining layer of said wall.

5. The combination as set forth in claim 1, said tube being of circular section.

6. The combination as set forth in claim 1, said tube being of rectangular section.

7. The combination as set forth in claim 1, said tube being of square section.

8. The combination as set forth in claim 1, said closed frame comprising a planar frame having a plurality of corner pieces in joining, sealed relation with respective adjoining portions of said tube.

9. The combination as set forth in claim 8, said planar frame adjoining portions having side faces facing inwardly of said frame, at least one of said faces being perforated therethrough; said planar frame being hollow and containing dessicant material.

10. The combination as set forth in claim 9, an inner surface of said tube located in opposed relation with said perforated face comprising aluminum.

11. The combination as set forth in claim 1, said tube cross-section having a periphery of less than twelve inches.

12. The combination as set forth in claim 1, said tube cross-section having a periphery of less than three inches.

13. The combination as set forth in claim 8, said frame being bonded in sealing relation between said glazing panes, being located adjacent the outer periphery of said panes.

14. The combination as set forth in claim 1, said hermetic sealing layer being selected from the group consisting of polyvinyl alcohol, polyvinylidene chloride, thermoplastic polyesters, ethylene vinyl alcohol copolymers, and combinations thereof.

15. The combination as set forth in claim 1, at least one said layer comprising paper.

* * * * *